US010221644B2

(12) United States Patent
Swinford

(10) Patent No.: US 10,221,644 B2
(45) Date of Patent: Mar. 5, 2019

(54) ROTATING TOOL

(71) Applicant: Jason Swinford, Spring, TX (US)

(72) Inventor: Jason Swinford, Spring, TX (US)

( * ) Notice: Subject to any disclaimer, the term of this patent is extended or adjusted under 35 U.S.C. 154(b) by 501 days.

(21) Appl. No.: 15/009,256

(22) Filed: Jan. 28, 2016

(65) Prior Publication Data

US 2017/0191331 A1 Jul. 6, 2017

Related U.S. Application Data

(63) Continuation-in-part of application No. 14/987,082, filed on Jan. 4, 2016.

(51) Int. Cl.
*E21B 31/18* (2006.01)

(52) U.S. Cl.
CPC ..... *E21B 31/18* (2013.01)

(58) Field of Classification Search
CPC ..... E21B 31/18
See application file for complete search history.

(56) References Cited

U.S. PATENT DOCUMENTS 4,061,389 A * 12/1977 Keller ..... E21B 23/006 175/315
4,848,820 A * 7/1989 Morrell ..... E21B 31/107 294/86.18
5,085,479 A * 2/1992 Taylor ..... E21B 31/20 294/86.17
5,454,420 A * 10/1995 Snider ..... E21B 17/021 166/117.5
5,584,342 A * 12/1996 Swinford ..... E21B 17/021 166/237
5,787,981 A * 8/1998 Taylor ..... E21B 4/006 166/237
7,946,348 B2 * 5/2011 Swinford ..... E21B 17/073 166/117.7

FOREIGN PATENT DOCUMENTS

GB 2303864 A * 3/1997 ..... E21B 23/00

* cited by examiner

*Primary Examiner* — Matthew R Buck
(74) *Attorney, Agent, or Firm* — Eric P. Mirabel, JD, LLM

(57) ABSTRACT

Disclosed is a rotating tool for inducing rotation, e.g., for activating and operating coil tubing tools for fishing target equipment in a bore casing of an oil well-bore. The rotating tool is connected with an end of coiled tubing reeled into the oil well-bore, and its other end is connected to a target equipment on which rotation is to be induced. The rotating tool converts linear motion in a first direction of the coiled tubing into rotation, and the rotation hence produced operates a coil tubing tool e.g., opening/closing jaws on an overshot. The rotating tool includes adjustable screws which allow the rotation resistance to be adjusted.

16 Claims, 7 Drawing Sheets

ROTATING TOOL

FIELD OF INVENTION

This invention relates to rotating tools for generating rotation to use with equipment installed within a bore casing of an oil well-bore, especially for coil-tubing applications.

BACKGROUND

Oil wells are generally formed by drilling a bore into the earth for accessing buried crude oil deposits, and then installing a variety of equipment within the bore to enable pumping of crude oil up to the earth's surface. During drilling, hollow metallic tubes (also known as 'casings') are inserted within the bore to prevent walls of bore from collapsing. In a deep enough bore, multiple hollow casings are installed vertically one above the other by screwing ends of adjacent sections with each other. The entire assembly of attached casings is commonly known as 'bore casing'.

Once a bore casing is formed, a variety of equipment (including crude oil pumping equipment and sensor equipment) is installed within the bore casing. In an operational oil well, crude oil is pumped to the surface of the earth from the buried crude oil deposits with the help of pumping equipment installed in the bore casing. However, the oil well production unit is vulnerable to failure of installed equipment within the bore casing, which can be caused by mechanical fatigue or electrical shorts or other problems, which can be exacerbated by changed conditions within the well-bore.

During installation of pumping equipment, or during troubleshooting of failed equipment in an operational oil well-bore, it is often necessary to retrieve equipment from the bore casing (also known as fishing). Retrieval of equipment which may be imperfectly installed or lie stuck within the bore casing, can be accomplished by grasping it with an overshot tool (having jaws) connected to the coiled tubing. Jaws of an overshot are generally opened and closed by rotation provided to the overshot. Additionally, rotation provided by the overshot can help to set free stuck equipment. Since the coil tubing cannot be rotated easily—but it can be moved up and down linearly from a drum powered by a drive motor, a mechanical transfer of linear motion of the coil tubing into rotational motion is required.

A rotating tool can be used in a well-bore with coil tubing in conjunction with a drilling jar. See e.g. U.S. Pat. No. 8,151,910 (incorporated by reference). While the drilling jar generates impacts and resultant shock waves along the coil tubing to aid in freeing the tubing or stuck equipment, the rotating tool generates rotation for the overshot and rotation for freeing the stuck equipment. The current designs of rotating tools do not work well with the hard accelerations needed to be applied to the coil tubing (it must be jerked up or down, or both) to generate the jarring effect. The current designs tend to rotate too freely, which can cause tools designed to operate when rotated to be unintentionally activated. The rotating tool described below solves these problems with the existing rotating tools.

SUMMARY

The invention is a rotating tool for inducing rotation. When included in coiled tubing of an oil well-bore, the rotating tool of the present invention is useful for operating or freeing target equipment within the bore casing of an oil well-bore. One end of the rotating tool is connected with an end of coiled tubing reeled into the oil well-bore, and its other end is connected to target equipment on which rotation is to be induced. The rotating tool converts linear motion (up or down) of the coiled tubing into rotation. The rotation hence produced is used to operate the target equipment; e.g., opening/closing jaws on an overshot.

In a rotating tool, a sliding assembly, including a shaft, slides within a housing assembly. Linear displacement of the shaft in one direction is converted into rotational motion in a first rotational direction through a tubular gear, which in turn induces rotation of the housing assembly and the target equipment in the first rotational direction.

The housing assembly includes a upper-sub, a barrel, a lower-sub and a first longitudinal bore. A mandrel of the sliding assembly is connected to the coiled tubing and is used to drive the shaft linearly through the first longitudinal bore. The upper-sub is screwed to one end of the barrel, the lower-sub is screwed to the opposite end of the barrel, and the distal end of the lower-sub is connected to the target equipment. The proximal end of the lower-sub includes a first set of axially-extending gear teeth.

The surface of the shaft includes axially-extending helical grooves. The tubular gear surrounds the grooved surface of the shaft and engages with the helical grooves through one or more adjustable screws which extend transversely through threaded holes in the tubular gear. Adjusting the extent to which the adjustable screws extend into the grooves can be used to exert varying degrees of pressure by the adjustable screws on the bottom of the grooves, and thereby varying the force required to make the tubular gear travel along the helical grooves (and the shaft). One end of the tubular gear includes a second set of multiple axially-extending gear teeth which mate with the corresponding first set of axially-extending gear teeth of the lower-sub, but permit rotation in one direction only.

Within the rotating tool, axial movement of the tubular gear is prevented beyond longitudinal separation between the lower-sub and a tubular head of the shaft. When the shaft is moved axially in a first linear direction and when the tubular gear is pushed against the lower-sub, the adjustable screws of the tubular gear slide along the helical grooves and cause the tubular gear to rotate in a first rotational direction. Since the second set of gear teeth of the tubular gear matingly engage with the first set of gear teeth of the lower-sub, rotation of the tubular gear also causes the lower-sub to rotate in the first rotational direction. And the rotation of the lower-sub also causes the entire housing assembly and the target equipment to rotate in the first rotational direction.

As described further below, the adjustment of the screws facilitates fishing operations where equipment is stuck and must be dislodged by activating a jar. Embodiments of the present invention will be discussed in greater details with reference to the accompanying figures in the detailed description which follows.

It should be understood that the drawings and the associated descriptions below are intended and provided to illustrate one or more embodiments of the present invention, and not to limit the scope of the invention. Also, it should be noted that the drawings are not be necessarily drawn to scale.

DETAILED DESCRIPTION

Figures 1A, 1B:
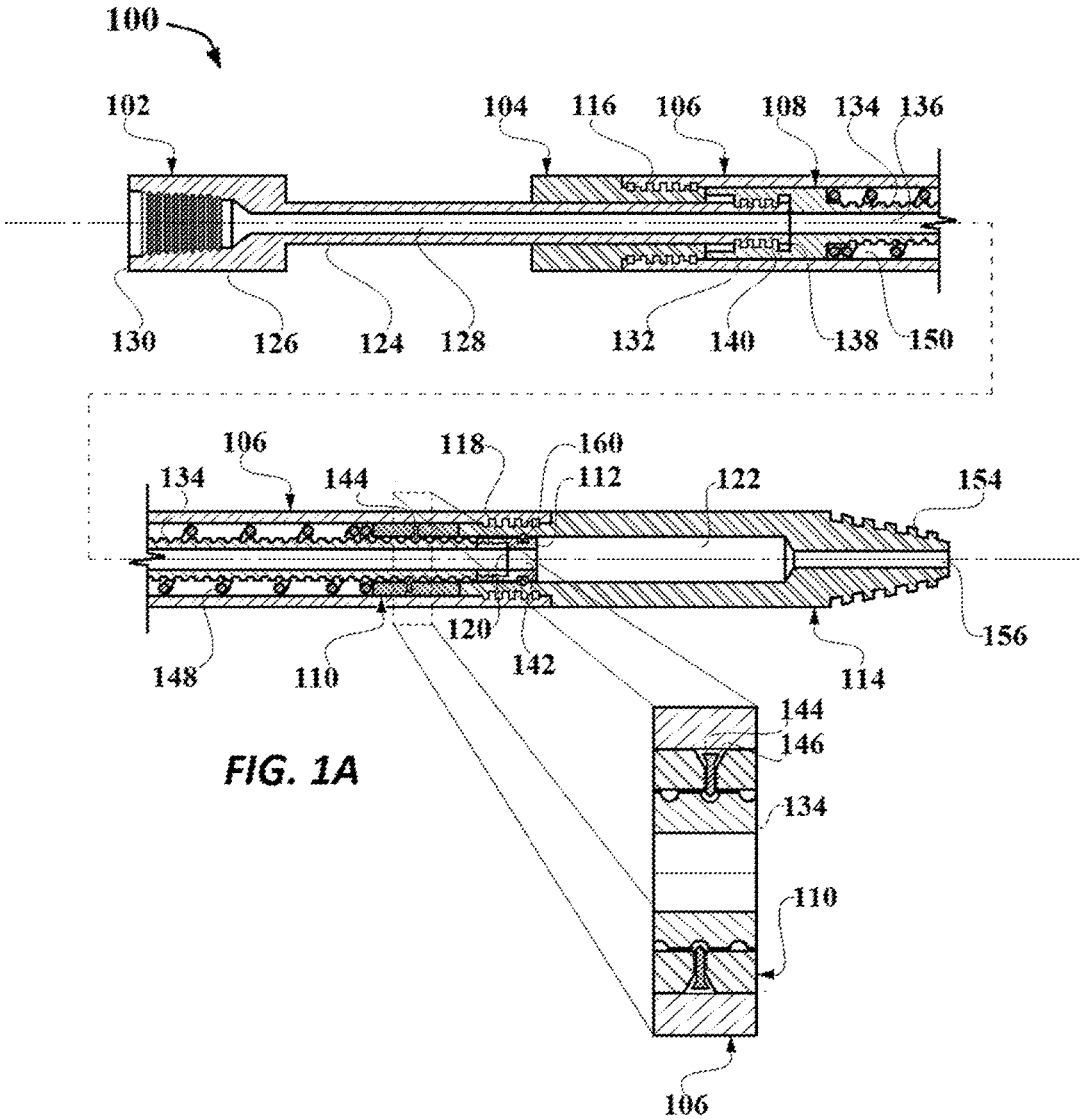
FIG. 1A is a cross-sectional view of a first embodiment of a rotating tool.
FIG. 1B is an expanded cross-sectional view of the portion of FIG. 1A shown as expanded by the lead lines.

Reference will now be made in detail to a first embodiment of a rotating tool of the invention with reference to the accompanying FIGS. 1A to 6B. As illustrated in these figures, rotating tool 100 comprises a mandrel 102, an upper-sub 104, a barrel 106, a shaft 108, a tubular gear 110, a piston 112 and a lower-sub 114. The mandrel 102, the shaft 108, and the piston 112 together form a longitudinal sliding assembly which is slideable within a housing assembly formed by the upper-sub 104, the barrel 106, and the lower-sub 114. To form the housing assembly, internally threaded portion 116 and 118 of the barrel 106 are screwed on to the upper-sub 104, and the lower-sub 114 respectively. Each of the upper-sub 104, the barrel 106, and the lower-sub 114 include a longitudinal cylindrical bore, and all three bores are aligned along a longitudinal axis of the barrel assembly so as to provide a passage for the sliding assembly to slide through. In FIG. 1A, the passage for sliding assembly to slide within the lower barrel is illustrated as path 122.

Mandrel 102 includes sliding cylinder 124, an outer cylinder 126 and a longitudinal bore 128 extending through the sliding cylinder 124 and the outer cylinder 126. A portion of the longitudinal bore 128 which lies in the outer cylinder 126 widens towards end 130 of the outer cylinder 126 and is internally threaded for connecting the rotating tool 100 to coiled tubing (shown in FIG. 7). Shaft 108 comprises of a tubular head 132, an externally grooved cylindrical region 134 and a longitudinal bore 136 extending through the head 132 and threaded cylindrical region 134. Portion of the sliding cylinder 124 which lies proximate to its end 138 is externally threaded (shown as externally threaded portion 140 in FIG. 1A). The externally threaded portion 140 is screwed into one end of the tubular head 132 of shaft 108. Piston 112 is a tubular cylinder and includes a longitudinal bore 142. Portion of the shaft 108 which lies proximate to its end 120 is externally threaded and is screwed into one end of the piston 112.

Figure 3:
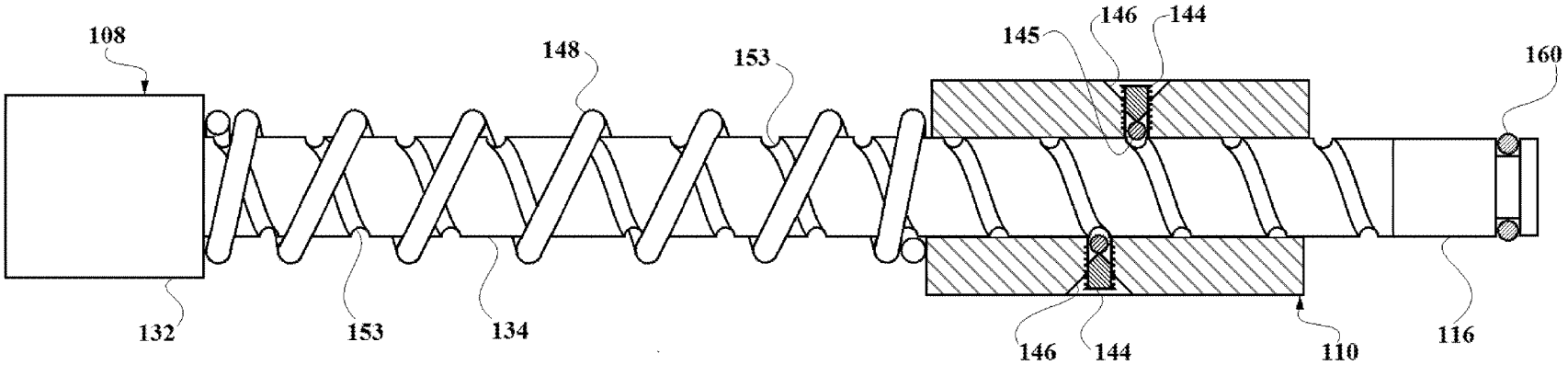
FIG. 3 is a perspective view illustrating engagement of the shaft and the tubular gear in the first embodiment.

Tubular gear 110 surrounds a portion of the grooved cylindrical region 134 and is engaged to its grooves 153 through adjustable screws 144 as best seen in FIG. 1B and FIG. 3. Depth of engagement of ball 145 at the tip of screw screws 144 in grooves 153 of grooved cylindrical region 134 can be adjusted by rotating the screws in or out through their corresponding threaded holes 146 in tubular gear 110. Ball 145 is optional at the tip of screws 144, and no ball or other types of interfaces with the grooves 153 are within the scope of the invention. A magnified view of engagement of tubular gear 110 with grooves 153 of grooved cylindrical region 134 is also illustrated in FIG. 1B. A compressible helical spring 148 surrounds threaded cylindrical region 134, as best seen in FIG. 3. Longitudinal extension of spring 148 is restricted to within of the linear edges of a dynamic region 150, which is bounded by the barrel 106, the externally helically grooved region 134, the tubular head 132, and the tubular gear 110.

Figure 4:
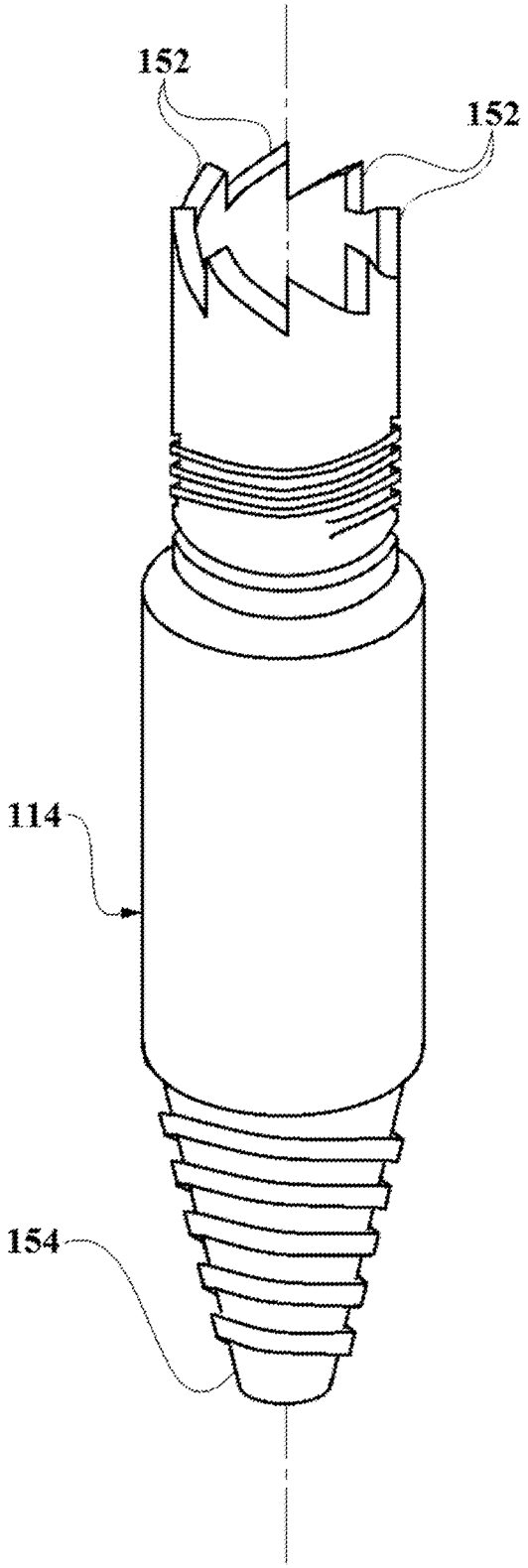
FIG. 4 is an elevational view of the lower-sub.
Figure 6A:
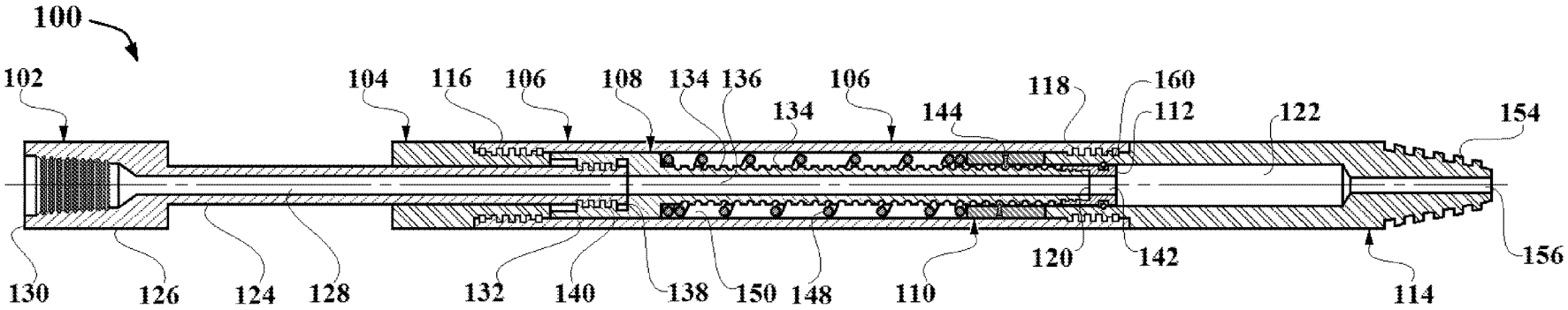
FIG. 6A is a cross-sectional view of the rotational tool in a "ready for down-stroke" position.
Figure 6B:
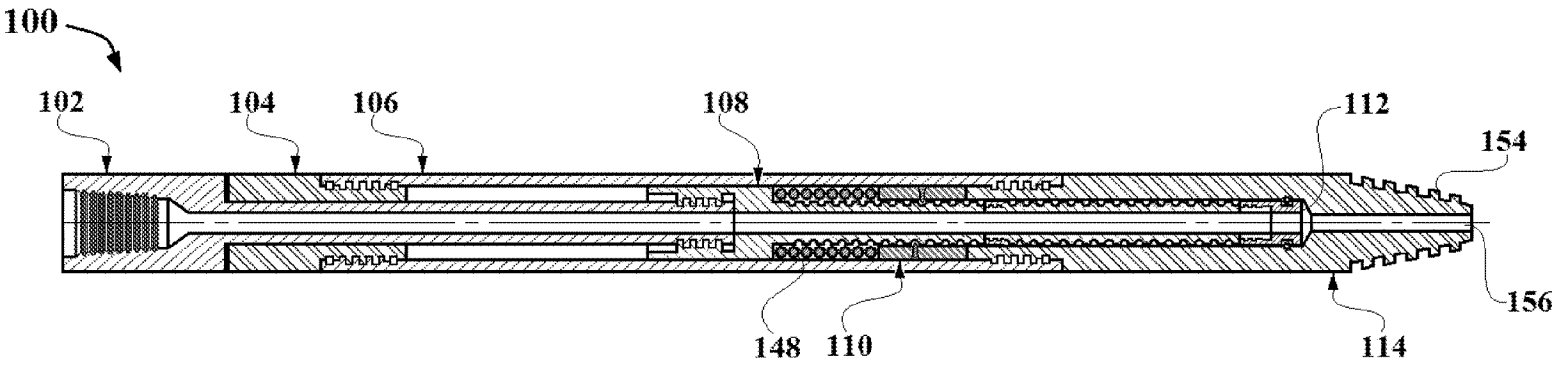
FIG. 6B is a cross-sectional view of the rotational tool in a "ready for up-stroke" position.

The lower-sub 114 further includes a first set of multiple axially-extending gear teeth 152 (as best seen in FIG. 4), an externally threaded tapered arm 154, an additional reduced diameter bore 156 connected to path 122 (as best seen in FIGS. 1A, 6A and 6B). In an installed coiled tubing assembly, the tapered arm 154 is preferably screwed into to a mating lower portion of the coiled tubing which extends into the oil well-bore, or directly connected with a fishing tool (such as an overshot) as described below and shown in FIG. 7. In a coiled tubing assembly having the rotating tool 100 installed, bore 128, bore 136, bore 142, path 122, and bore 156 together provide a fluid flow path for a fluid (flowing along the coil tubing) to pass through rotating tool 100.

Figure 2B:
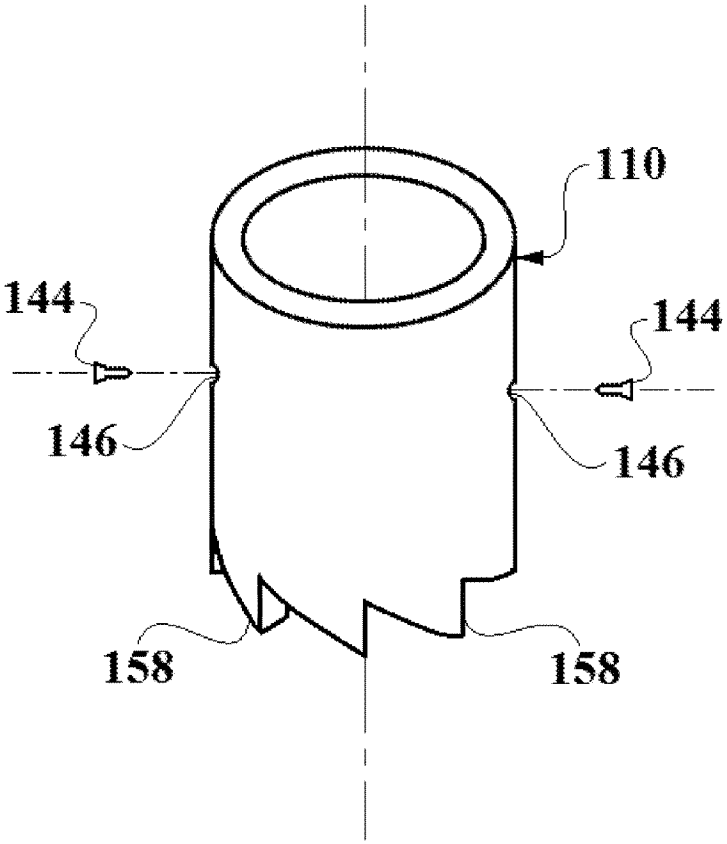
FIG. 2B is an elevational view of the tubular gear.
Figure 2A:
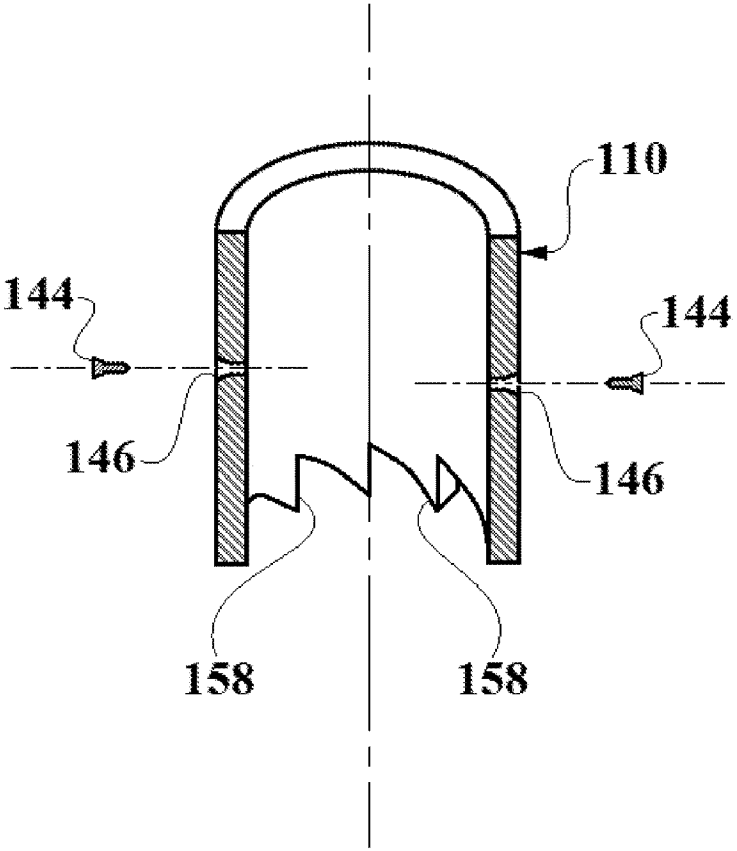
FIG. 2A illustrates a cross-sectional view of a tubular gear used in the first embodiment.

FIGS. 2A and 2B illustrates structure of tubular gear 110 in greater detail. Tubular gear 110 includes two holes 146 and a second set of multiple axially-extending gear teeth 158. Holes 146 are internally threaded to allow screwing or unscrewing of the threaded portion of screw 144 through them. When fully screwed in, ball 145 at the tip of screws 144 can engage with the lower portion of grooves 153 of threaded cylindrical region 134.

To prevent leakage of fluid flowing through the rotating tool 100 (for example, drilling fluid flowing through the coiled tubing) into the dynamic region 150 through the interface between the piston 112 and path 122, rubber O-rings 160 are provided around piston 112 (illustrated in FIG. 1 and FIG. 3). A detailed perspective view of the assembly of the shaft 108, the spring 148, the tubular gear 110 (cross-sectional view), and the piston 112 with O-rings 160 as installed in rotating tool 100 is shown in FIG. 3.

Figure 5:
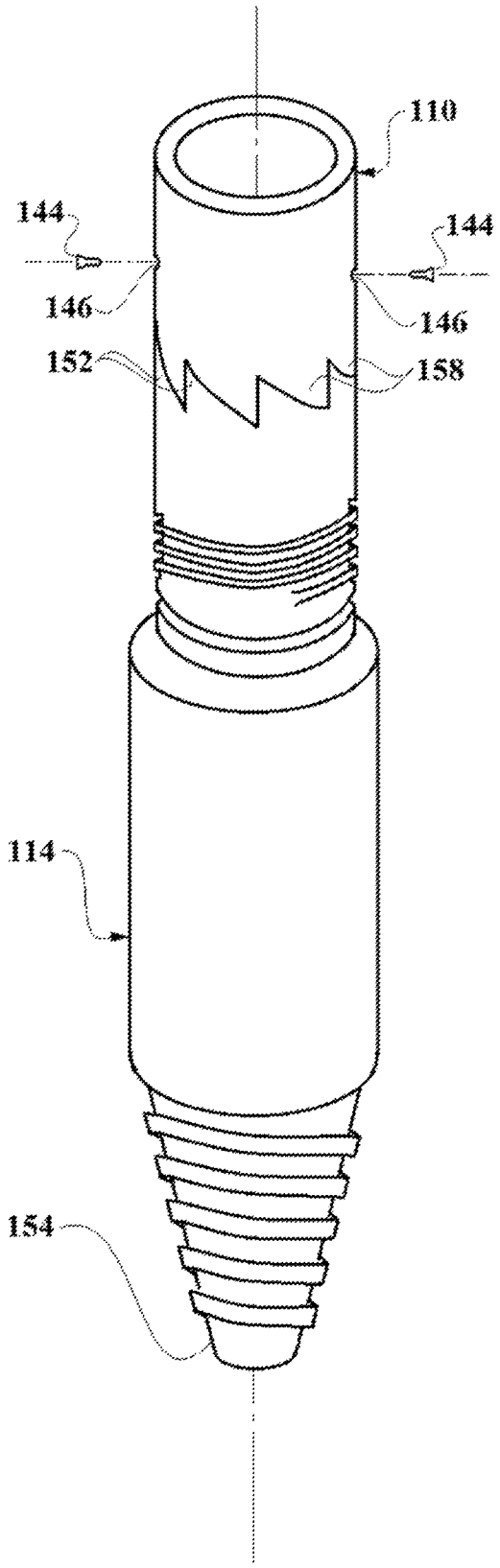
FIG. 5 is an elevational view of the lower-sub engaged with the tubular gear.

As shown in FIG. 5, the second set of gear teeth 158 of the tubular gear 110 matingly fits into the first set of gear teeth 152 of the lower-sub 114. In such a mated assembly, rotation of tubular gear 110 (as it travels down the helical groove in shaft 108) would also cause the lower-sub 114 to rotate in same rotational direction.

Figure 7:
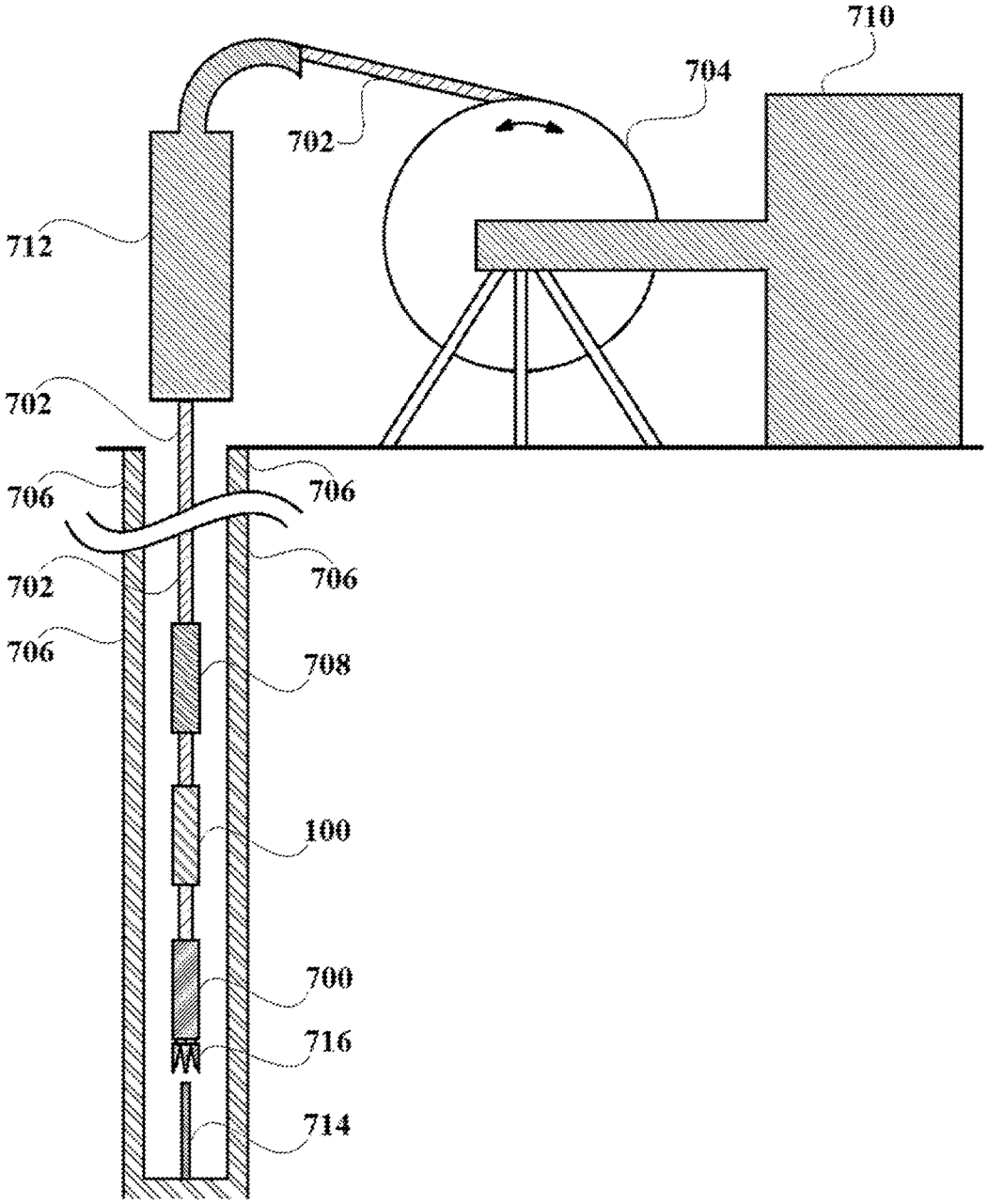
FIG. 7 illustrates a coil tubing set up for fishing including a rotating tool of the present invention and a drilling jar.

Operation of the rotating tool 100 for producing rotation during down-stroke will now be explained in detail with reference to FIGS. 6A-6B. As illustrated in FIG. 6A, to initiate a down-stroke, the mandrel 102 is pushed down into the housing assembly through the upper-sub 104 by reeling out coil tubing 702 from drum 704 (as illustrated in FIG. 7). As sliding cylinder 124 is pushed in by this action, the shaft 108 (along with the piston 112) gets pushed into path 122. Since tubular gear 110 is engaged with grooves 153 of the shaft 108 through screws 144, axial force is also exerted on the tubular gear 110. Since axial movement of the tubular gear 110 is prevented beyond the lower-sub 114, the exerted force causes engaged tips of screws 114 to slide through the helical grooves 153 of the shaft 108. Sliding of screws 114 through helical grooves 153 of shaft 108 causes the tubular gear 110 to rotate in a first rotational direction (for example, in clockwise direction in the present embodiment). Since gear teeth 158 of the tubular gear 110 are matingly engaged with gear teeth 152 of the lower-sub 114, rotation of tubular gear 110 also causes the lower-sub 114 to rotate in a first rotational direction. Still further, since the lower-sub 114 connected with the barrel 106, rotation of lower-sub 114 further causes the entire housing assembly to rotate in the first rotational direction. As a result of rotation, tubular gear 110 (through screws 144) also moves up the groove towards the tubular head 132. Finally, when the entire length of sliding cylinder 124 is moved into the housing assembly (as illustrated in FIG. 6B), the down-stroke concludes, and the tubular gear 110 sits closer to the tubular head 132. Further, the spring 148 lies compressed between the tubular head 132 and the tubular gear 110.

During up-stroke, the pushing force on mandrel 102 is released and a pulling force is applied on mandrel 102 (and to the shaft 108) by reeling in coil tubing 702 from drum 704 (as illustrated in FIG. 7). When the shaft 108 is pulled out, linear movement of the tubular gear 110 towards the upper-sub 104 is opposed by the spring 148, but the spring 148 now gradually begins to uncompress into the additional availability of space in dynamic region 150. Pressure released from uncompressing spring 148 forces tubular gear 110 towards lower-sub 114. As a result of force exerted by the uncompressing spring, the screws 144 of the tubular gear 110 start to sliding in a reverse direction along the grooves 153 of the shaft 108. Such a sliding causes the tubular gear 110 to rotate in a counter-clockwise direction (i.e. opposite to rotational direction during the down-stroke). However, due to structure and mating profile of gear teeth 152 and 158, rotation of tubular gear 110 in counter-clockwise direction does not induce any rotation on the lower-sub 114 (and hence in the housing assembly). During up-stroke, teeth 158 simply slidingly rotate over the mated gear teeth 152 (the teeth 158 and 154 only lockingly engage in one rotational direction).

The sensitivity of rotating tool 100 to produce desired a desired amount of rotation per unit of pushing force on the mandrel 102 during down-stroke can be adjusted by the degree of engagement of screws 144 with the grooves 153 of the shaft 108. Pressure exerted by screws 144 at the bottom of the grooves 153 can be adjusted. Higher friction between the tips of the screws 144 and grooves 153 of the shaft 108, would result in lesser rotation of tubular gear 110 per unit force applied on mandrel 102. To achieve larger amount of rotation per unit of pushing force, friction between screws 144 and grooves 153 of shaft 108 should be reduced, and screws 144 should not be driven to an extent that their respective tips become tightly engaged with the grooves 153 of the shaft 108.

When screws 144 is driven in through the hole 146, ball 145 at the tip of screw 144 engages firmly with the groove of the shaft 108. Driving the screw 144 deeper into hole 146 would push the metallic ball 145 tightly against the groove of shaft 108, and hence the ball 145 would engage with a greater pressure and friction with the groove of shaft 108. Hence, positioning of screw 144 within hole 146 can be used to adjust the magnitude of pressure exerted by the metallic ball 145 on the grooves 153 of shaft 108. In other words, level of engagement of tubular gear 110 with grooves 153 of the shaft 108 can be adjusted by driving the screw 144 suitably within hole 146. The structure and dimensions of hole 146, screw 144 and the metallic ball 145 can be chosen suitably to ensure that while being engaged with the groove of the shaft 108, the ball 145 remains engaged with the hole 146 too, and that driving of screw 144 into hole 146, or any rotation of tubular gear 110 around the shaft 108 does not result in losing the engagement of metallic ball 145 with the hole 146. As an example, to ensure that driving of screw 144 into hole 146 does not result in losing the engagement of metallic ball 145 with the hole 146, the hole may be constructed in a manner such that driving the screw 144 into the hole 146 is restricted beyond a threshold.

FIG. 7 shows the assembly of coil tubing 702, reeled from a drum 704 by a drive motor 710 and an injector 712 in an oil well-bore casing 706. The coil tubing 702 is connected with a drilling jar 708 and with a rotating tool 100, which drives an overshot 700 having jaws 716. To retrieve a target equipment 714 from a well bore, the coil tubing 702 is reeled down from the drum by a drum 704 by a drive motor 710 and an injector 712. To avoid dislodging the equipment 714 and having it fall down the well bore, lowering of coil tubing 702 slows as it nears the equipment 714. At the time of contact between the distal end of the overshot 700 and the equipment 714, lowering is immediately stopped. The adjustable screws 144 in the rotating tool 100 have been set so that there is little friction between them and the helical grooves 153 of shaft 108, and rotation of the lower-sub 114 (or the housing assembly) and the overshot 700 is induced by relatively modest downward acceleration of the assembly of coiled tubing 702 by the motor 710. The rotation closes the jaws 716 of the overshot on the equipment 714 so that the equipment 714 is grasped by jaws 716. Finally, the assembly of coiled tubing 702 is reeled up (carrying up the equipment 714 grasped in jaws 716).

In the event the equipment 714 is lodged or stuck in the well bore and needs to be freed by activating the jar 708, the assembly of coiled tubing 702 must be rapidly accelerated up or down to induce a jarring impact. Additionally, where it is known that equipment 714 is stuck firmly, one can tighten screws 144 before lowering the assembly of coiled tubing 702, and then contact the stuck equipment 714 with a solid impact on it by the overshot 700, before activating the overshot jaws 716 to close, using another strong downward force (which may help dislodge the stuck equipment 714).

Alternatively, the first try to grasp and release stuck equipment 714 can be done with the screws 144 in a loosened setting, so the equipment 714 is not accidentally dislodged. The jaws 716 are then closed with a downward force on the assembly of coil tubing 702. If attempts to release the equipment 714 fail, with or without firing the jar 708, the jaws 716 can be opened by applying another rotational force through the rotating tool 100 by pushing the mandrel 102 downwardly again (following an up-stroke of it). The assembly of coil tubing 702 can then be reeled up to the surface without the equipment 714, the screws 144 tightened, and then lowered again so that overshot 700 impacts the stuck equipment 714, before grasping it again with jaws 716 and firing the jar 708 again, if necessary. The impact of the overshot 700 may be enough to help free the equipment 714.

In different embodiments the pitch of the grooves 153 on shaft 108 can be varied, so as to reach a specified degree of rotation for each operating cycle of a rotating tool 100, i.e., one full downstroke or upstroke of mandrel 102. In operations where after grasping equipment 714, jar 708 is activated to fire bi-directionally several times to aid in dislodging the stuck equipment 714, the pitch on grooves 153 can still allow control of the grasp strength of the jaws 716. For example, first the equipment 714 is grasped with a grip strength sufficient to lift it, but not significantly more—in the event equipment 714 has components which could be damaged by an over-strength grasp by jaws 716. Then, if the equipment 714 cannot readily be lifted by reeling drum 704 up, one would activate the drilling jar 708. Assuming that three cycles of activating the jar 708 bi-directionally (where it fires six times in total) would power a calibrated overshot 700 to exert a force increase between 1,000-50,000 psi at its jaws 716, such increase would then be applied by jaws 716 on the equipment 714—before one again attempts to lift it. This feature avoids the risk of damaging equipment in the event the overshot's 700 grip strength at its jaws 716 is not calibrated, and if the number of activations of jar 708 is not controlled.

Various other types of fishing tools and coil tubing set-ups can also be used in an oil well-bore. It is to be understood that the foregoing description and embodiments are intended to merely illustrate and not limit the scope of the invention. Other embodiments, modifications, variations and equivalents of the invention are apparent to those skilled in the art and are also within the scope of the invention, which is only described and limited in the claims which follow, and not elsewhere.

What is claimed is:

1. A method of fishing to remove an object from a well-bore, comprising:

attaching a rotating tool having a tubular gear, said rotating tool attached to a fishing tool, to one end of a length of coil tubing which is wound around a drum, said fishing tool including movable jaws, said jaws closing to grasp an object on rotation of the tubular gear in a first rotational direction;

reeling the coil tubing from the drum with a drive motor down into a well-bore;

operating the coil tubing to induce rotation of the tubular gear in the first rotational direction so as to cause said jaws to grasp the object, wherein the rotating tool includes:

a housing assembly including a upper-sub, a barrel, a lower-sub and a first longitudinal bore, said lower-sub having a first set of multiple axially-extending gear teeth at one end;

a sliding assembly being slidable within the first longitudinal bore, said sliding assembly including a mandrel and a shaft, said shaft further including one or more axially-extending helical grooves on an exterior of said shaft;

the tubular gear within the first longitudinal bore, said tubular gear including a second longitudinal bore and a second set of axially-extending gear teeth at one end capable of mating with said first set when the tubular gear is rotated in the first rotational direction to induce rotation of the lower sub and housing assembly in said first rotational direction, but wherein the first and second sets of axially-extending gear teeth slide past each other so the lower sub and housing assembly are not rotated when the tubular gear is rotated in an opposite rotational direction, and said shaft extending through said second longitudinal bore, wherein said upper-sub is affixed to the coil tubing and to one end of the barrel;

said lower-sub is screwed into the opposite end of the barrel, said lower-sub is mated to the fishing tool;

said tubular gear engages with said grooves of the shaft through one or more adjustable screws, which extend transversely through threaded holes in the tubular gear and are configured to be adjusted to extend varying distances into the second longitudinal bore and thereby into the grooves, and said adjustment is further configured to be used to exert varying degrees of pressure by the screws on the bottom of the grooves such that resistance to rotation of the tubular gear upon axial movement of the shaft is altered; and moving the shaft in a first axial direction induces rotation of the tubular gear in the first rotational direction, thereby causing the lower sub and housing assembly to rotate in the first rotational direction and thereby causing the jaws to close and to grasp said object; and reeling up the coil tubing to remove the object from the well-bore.

2. The method of claim 1 wherein said fishing tool is an overshot.

3. The method of claim 1 wherein the adjustment is by rotating said screws.

4. The method of claim 1 wherein said one or more screws has a ball at an end of each of said one or more screws which engages the grooves.

5. The method of claim 1 wherein the amount by which the adjustable screws extend into the second longitudinal bore, and thereby generate increased friction on the tubular gear and increased resistance to rotation, is varied depending on the object being grasped and a location of the object within the well-bore.

6. The method of claim 1 wherein after the jaws close and grasp said object, if the object is lodged and cannot be reeled up, the object is released, the coiled tubing is reeled up, and the screws are tightened, before the coil tubing is again reeled into the well bore.

7. The method of claim 1 wherein the axially-extending helical grooves are at a specified pitch and induce a known number of rotations to the lower-sub.

8. A rotating tool connected to coiled tubing and to target equipment, said rotating tool being driven by the coiled tubing for inducing rotation on the target equipment, said rotating tool comprising:

a housing assembly including a upper-sub, a barrel, a lower-sub and a first longitudinal bore, said lower-sub having a first set of multiple axially-extending gear teeth at one end;

a sliding assembly being slidable within the first longitudinal bore, said sliding assembly including a mandrel and a shaft, said shaft further including one or more axially-extending helical grooves on an exterior of said shaft;

a tubular gear within the first longitudinal bore, said tubular gear including a second longitudinal bore and a second set of axially-extending gear teeth at one end capable of mating with said first set when the tubular gear is rotated in a first rotational direction to induce rotation of the lower sub housing assembly in said first rotational direction, but wherein the first and second sets of axially-extending gear teeth slide past each other so the lower sub housing assembly are not rotated when the tubular gear is rotated in an opposite rotational direction, and said shaft extending through said second longitudinal bore, wherein said upper-sub is affixed to the coil tubing and to one end of the barrel;

said lower-sub is screwed into the opposite end of the barrel, said lower-sub is mated to the target equipment;

said tubular gear engages with said grooves of the shaft through one or more adjustable screws, which extend transversely through corresponding holes in the tubular gear and are configured to be adjusted to extend varying distances into the second longitudinal bore and thereby into the grooves, and said adjustment is further configured to be used to exert varying degrees of pressure by the screws on the bottom of the grooves such that resistance to rotation of the tubular gear upon axial movement of the shaft is altered; and wherein moving the shaft in a first axial direction induces rotation of the tubular gear in the first rotational direction, thereby causing the lower sub and housing assembly to rotate in the first rotational direction and thereby inducing rotation on the target equipment.

9. The rotating tool of claim 8, wherein said target equipment is a fishing tool having jaws which open and close upon rotation.

10. The method of claim 8 wherein said one or more screws has a ball at an end of each of said one or more screws which engages the grooves.

11. The method of claim 8 wherein the axially-extending helical grooves are at a specified pitch and induce a known number of rotations to the lower-sub.

12. A method of fishing to remove an object from a well-bore, comprising:

attaching a drilling jar to a length of coil tubing which is wound around a drum whose rotation is driven by a motor;

attaching a rotating tool to said coil tubing, said rotating tool having a tubular gear and being attached to a fishing tool, said fishing tool including movable jaws, said jaws closing to grasp an object on rotation of the tubular gear in a first rotational direction;

reeling the coil tubing from the drum by a drive motor down into a well-bore;

operating the coil tubing to induce rotation of the tubular gear in the first rotational direction so as to cause said jaws to grasp the object, wherein the rotating tool includes:

a housing assembly including a upper-sub, a barrel, a lower-sub and a first longitudinal bore, said lower-sub having a first set of multiple axially-extending gear teeth at one end;

a sliding assembly being slidable within the first longitudinal bore, said sliding assembly including a mandrel and a shaft, said shaft further including one or more axially-extending helical grooves on its exterior;

the tubular gear within the first longitudinal bore, said tubular gear including a second longitudinal bore and a second set of axially-extending gear teeth at one end capable of mating with said first set when the tubular gear is rotated in the first rotational direction to induce rotation of the lower sub and housing assembly in said first rotational direction, but wherein the first and second sets of axially-extending gear teeth slide past each other so the lower sub and housing assembly are not rotated when the tubular gear is rotated in an opposite rotational direction, and said shaft extending through said second longitudinal bore, wherein said upper-sub is affixed to the coil tubing and to one end of the barrel;

said lower-sub is screwed into the opposite end of the barrel, said lower-sub is mated to the fishing tool;

said tubular gear engages with said grooves of the shaft through one or more adjustable screws, which extend transversely through threaded holes in the tubular gear and are configured to be adjusted to extend varying distances into the second longitudinal bore and thereby into the grooves, and said adjustment is further configured to be used to exert varying degrees of pressure by the screws on the bottom of the grooves such that resistance to rotation of the tubular gear upon axial movement of the shaft is altered; and moving the shaft in a first axial direction induces rotation of the tubular gear in the first rotational direction, thereby causing the lower sub and housing assembly to rotate in the first rotational direction and thereby causing the jaws to close and to grasp said object;

reeling up the coil tubing but if the object is lodged or resists the upward reeling, again inducing the rotating tool to rotate in the first rotational direction so as to cause the jaws to open and release the object;

reeling up the rotational tool and tightening the adjustable screws;

reeling down the coil tubing, grasping the object again, and activating the jar; and reeling up the coil tubing to bring the object to the surface.

13. The method of claim 12 wherein said one or more screws has a ball at an end of each of said one or more screws which engages the grooves.

14. The method of claim 12 wherein the drilling jar is activated in both the up and down direction by rapidly rotating the drum with the motor.

15. The method of claim 12 wherein the axially-extending helical grooves are at a specified pitch and induce a known number of rotations to the lower-sub.

16. The method of claim 15 wherein each rotation of the lower-sub is calibrated to induce a specified increment of closure to jaws, or a specified grip strength of the jaws.

* * * * *